US010126069B2

(12) United States Patent
Sun et al.

(10) Patent No.: US 10,126,069 B2
(45) Date of Patent: Nov. 13, 2018

(54) THREE-DIMENSIONAL HEAT TRANSFER DEVICE

(71) Applicant: COOLER MASTER CO., LTD., New Taipei (TW)

(72) Inventors: Chien-Hung Sun, New Taipei (TW); Lei-Lei Liu, New Taipei (TW); Xiaomin Zhang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 28 days.

(21) Appl. No.: 15/257,805

(22) Filed: Sep. 6, 2016

(65) Prior Publication Data

US 2017/0227298 A1 Aug. 10, 2017

(30) Foreign Application Priority Data

Feb. 5, 2016 (CN) ..... 2016 1 0082174

(51) Int. Cl.
*F28D 15/04* (2006.01)
*F28D 15/02* (2006.01)
*F28F 1/32* (2006.01)

(52) U.S. Cl.
CPC ..... *F28D 15/04* (2013.01); *F28D 15/0266* (2013.01); *F28D 15/046* (2013.01); *F28F 1/32* (2013.01)

(58) Field of Classification Search
CPC .... F28D 15/04; F28D 15/0266; F28D 15/046; F28D 2021/0028; F28D 2021/0029;
(Continued)

(56) References Cited

U.S. PATENT DOCUMENTS 3,255,702 A * 6/1966 Gehrm ..... F04D 7/065 415/134
6,938,680 B2 * 9/2005 Garner ..... F28D 15/04 165/104.26

(Continued)

FOREIGN PATENT DOCUMENTS

CN 100470776 C 3/2009
TW M517314 U 2/2016

OTHER PUBLICATIONS

TW Office Action dated Jun. 19, 2017 as received in Application No. 105104267.

*Primary Examiner* — Justin Jonaitis
(74) *Attorney, Agent, or Firm* — Maschoff Brennan

(57) ABSTRACT

A three-dimensional heat transfer device includes a vapor chamber and at least one heat pipe. The vapor chamber has a first plate and a second plate opposite to each other, and a first capillary structure is disposed on an inner surface of the first plate. A second capillary structure is disposed in the heat pipe, the second capillary structure has a contact portion extending out of the heat pipe and exposed therefrom. The heat pipe is vertically inserted through the second plate. The contact portion extends into the vapor chamber and is connected to the first capillary structure, so that the first and second capillary structures communicate with each other. Therefore, an overall three-dimensional heat transfer effect can be achieved, and a desired optimized heat dissipation effect is obtained when the vapor chamber collaborates with the heat pipe.

18 Claims, 8 Drawing Sheets

(58) Field of Classification Search
CPC . F28F 1/32; H01L 23/40; H01L 23/46; H01L 23/473; H01L 23/4735
USPC ..... 165/80.4, DIG. 531
See application file for complete search history.

(56) References Cited

U.S. PATENT DOCUMENTS

2003/0010477 A1* 1/2003 Khrustalev ..... F28D 15/0266 165/104.33
2005/0173098 A1* 8/2005 Connors ..... F28D 15/02 165/104.33
2007/0272399 A1* 11/2007 Nitta ..... F28D 15/0233 165/185
2008/0036076 A1* 2/2008 Ouyang ..... H01L 23/34 257/714
2008/0144319 A1* 6/2008 Chang ..... B82Y 10/00 362/294
2011/0000649 A1* 1/2011 Joshi ..... H01L 23/427 165/104.26
2017/0176112 A1* 6/2017 Sarraf ..... F28D 15/04

* cited by examiner

THREE-DIMENSIONAL HEAT TRANSFER DEVICE

TECHNICAL FIELD

The present invention relates to a heat transfer device and, in particular, to a three-dimensional heat transfer device.

BACKGROUND

In regard to heat transfer, in order to dissipate heat generated from heating elements, conventional heat transfer devices utilize a heat conduction plate and a heat pipe to transfer heat, and cooling devices (e.g. fins and fans) are also utilized to dissipate heat, as described below.

The heat conduction plate is in contact with the heating element, the heat pipe is connected between the heat conduction plate and the cooling device, so that the heat generated from the heating element is transferred to the heat conduction plate first, and then the heat is transferred from the heat conduction plate to the cooling device via the heat pipe for heat dissipation.

However, the heat conduction plate and the heat pipe in the conventional heat transfer device work individually, and a capillary structure of the heat conduction plate is not connected to the capillary structure of the heat pipe. As a result, the heat conduction plate or the heat pipe transfers heat individually in a plane manner instead of an overall three-dimensional manner. In other words, heat dissipation is not achieved well.

Accordingly, the inventor made various studies to overcome the above problems, on the basis of which the present invention is accomplished.

SUMMARY

It is an object of the present invention to provide a three-dimensional heat transfer device whereby a capillary structure of a heat pipe and a capillary structure of a vapor chamber communicate with each other, and as a result, an overall three-dimensional heat transfer effect is achieved, and a desired optimized heat dissipation effect is obtained when a vapor chamber collaborates with the heat pipe.

Accordingly, the present invention provides a three-dimensional heat transfer device, comprising: a vapor chamber, the vapor chamber including a first plate and a second plate opposite to each other, a first capillary structure being disposed on an inner surface of the first plate; and a heat pipe, a second capillary structure being disposed inside the heat pipe, the second capillary structure having a contact portion extending out of the heat pipe and exposed therefrom, wherein the heat pipe is inserted through the second plate, and the contact portion extends into the vapor chamber and is connected to the first capillary structure, so that the first capillary structure and the second capillary structure communicate with each other.

The present invention provides another three-dimensional heat transfer device, comprising a vapor chamber including a first plate and a second plate opposite to each other, a first capillary structure being disposed on an inner surface of the first plate; and a heat pipe, the heat pipe being disposed with a second capillary structure inside and having an inner section, the inner section including an opening, the second capillary structure including a contact portion which is arranged in the opening and exposed, the heat pipe being inserted through the second plate, the inner section extending into the vapor chamber, the contact portion being connected to the first capillary structure via the opening, so that the first capillary structure and the second capillary structure communicate with each other.

Compared with conventional techniques, the present invention has the following functions. By making the second capillary structure of the heat pipe connect and communicate with the first capillary structure of the vapor chamber, an overall three-dimensional heat transfer effect is achieved, and a desired optimized heat dissipation effect is obtain when the vapor chamber collaborates with the heat pipe.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 5:
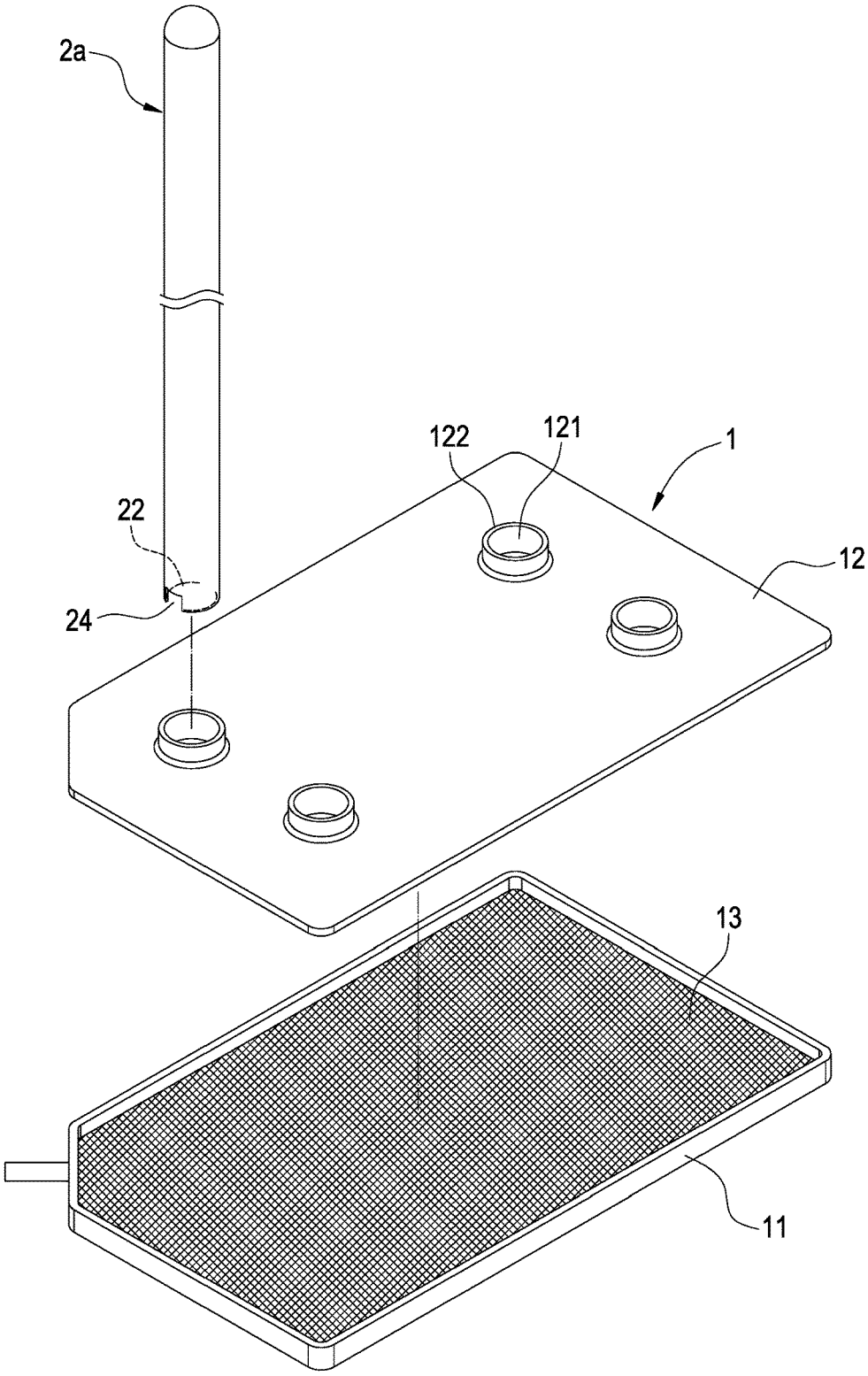
FIG. 5 is a perspective exploded view according to the second embodiment of the present invention.
Figure 6A:
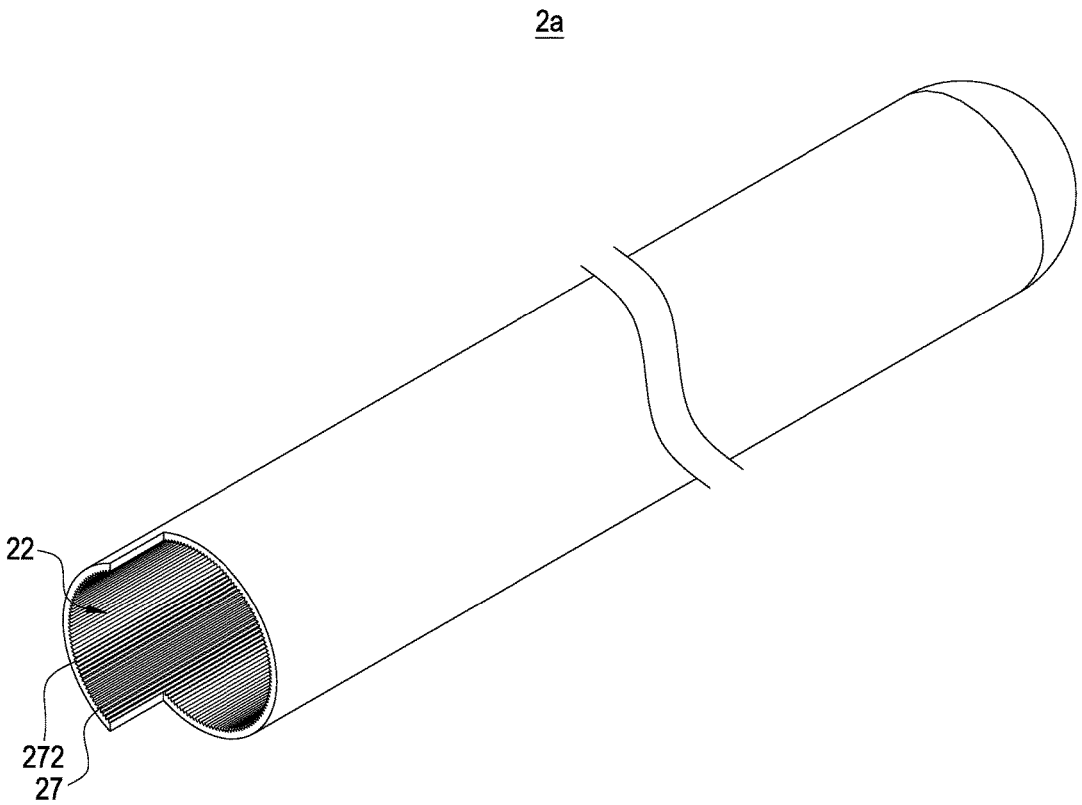
FIG. 6A is a perspective view from another viewing angle illustrating a heat pipe of the first type according to the second embodiment of the present invention.
Figure 6B:
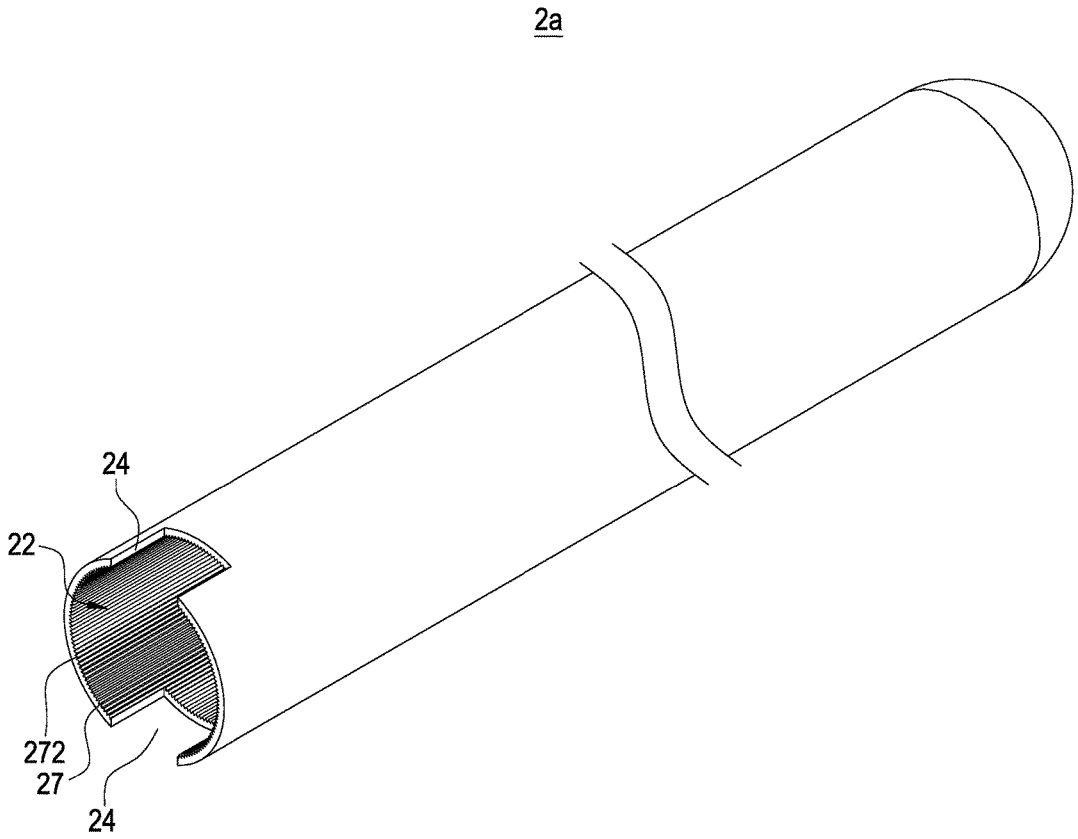
FIG. 6B is a perspective view from another viewing angle illustrating the heat pipe of the second type according to the second embodiment of the present invention.
Figure 7:
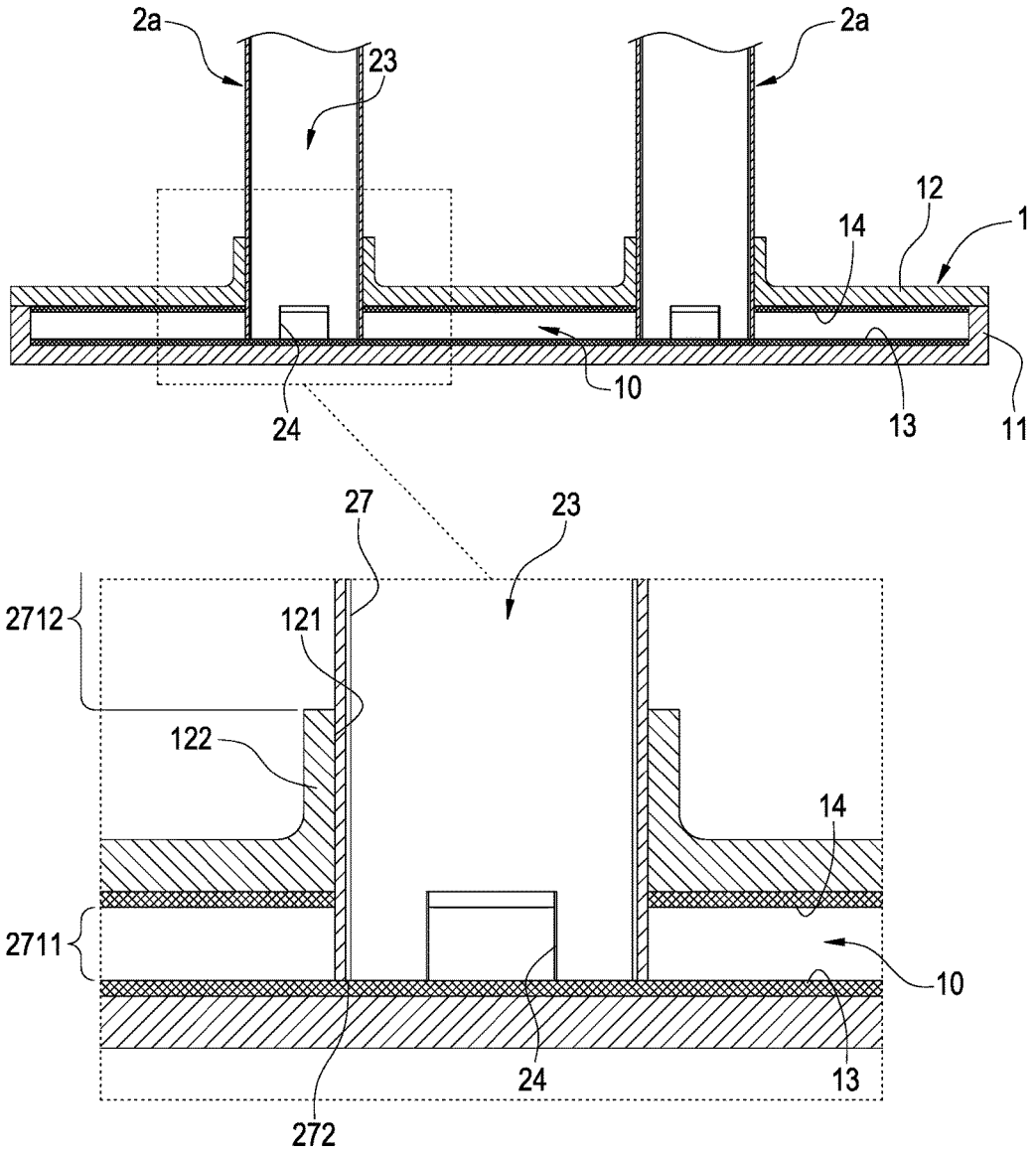
FIG. 7 is a cross-sectional view and also a partially enlarged view illustrating the second embodiment of the present invention after assembly.

The present invention provides a three-dimensional heat transfer device. FIGS. 1 to 4 show the first embodiment of the present invention, and FIGS. 5 to 7 show the second embodiment of the present invention.

As shown in FIGS. 1 to 4, according to the first embodiment of the present invention, the three-dimensional heat transfer device includes a vapor chamber 1, at least one heat pipe 2 and a working fluid flowing inside the vapor chamber 1 and the heat pipe 2 (not illustrated).

The vapor chamber 1 has a first plate 11 and a second plate 12 opposite to each other, and a cavity 10 is formed between the first plate 11 and the second plate 12. The vapor chamber 1 can be an integral structure and also can be a combined structure. In the present embodiment, the combined structure disclosed therein is merely representative for purposes of describing an example of the present invention. That is to say, the second plate 12 can be assembled to the first plate 11 to form the vapor chamber 1 having the cavity 10 inside.

A first capillary structure 13 is disposed on an inner surface of the first plate 11, a third capillary structure 14 (see FIG. 4) is disposed on an inner surface of the second plate 12, and the first and third capillary structures 13, 14 face each other. The first and third capillary structures 13, 14 can consist of sintered powder, sintered ceramic powder, metal web, or metal groove, and the present invention is not limited in this regard. However, in some embodiments, an inner surface of the second plate 12 is not disposed with the third capillary structure 14. In other words, only the inner surface of the first plate 11 is disposed with the capillary structure (i.e. the first capillary structure 13).

The second plate 12 forms at least one insertion hole 121. In the present embodiment, there are multiple insertion holes 121 for purposes of describing an example. Therefore, there are also multiple heat pipes 2 corresponding in number to the number of the insertion holes 121. Furthermore, a flange 122 in a circular form extends outwardly from a periphery of each insertion hole 121, thereby facilitating fixed connection with the heat pipe 2.

The heat pipe 2 is a hollow tube which has a second capillary structure 21 disposed inside, and the second capillary structure 21 has a contact portion 212 extending out of the heat pipe 2 to be exposed. In the present embodiment, one end (hereinafter referred to as the insertion end but not labelled) of the heat pipe 2 forms an opening 22 (see FIG. 3), the second capillary structure 21 includes two capillary elements 211 (see FIG. 4) arranged spaced apart and side by side so as to form a vapor passage 23 between the two capillary elements 211. Each of the two capillary elements 211 includes an exposed section 2111, the contact portion 212 consists of the exposed section 2111 of each of the two capillary elements 211, and thereby the vapor passage 23 of the heat pipe 2 communicates with the cavity 10 by means of the contact portion 212. The second capillary structure 21 can consist of sintered powder, ceramic powder, metal web or metal grooves, and the present invention is not limited in this regard. In the present embodiment, the second capillary structure 21 consists of sintered powder for purposes of describing an example of the present invention.

Each heat pipe 2 is inserted through each insertion hole 121 correspondingly to be erected on the second plate 12, and the insertion end of the heat pipe 2 is utilized for insertion, so that the opening 22 is exposed within the cavity 10. The contact portion 212 of the second capillary structure 21 extends out from the opening 22 to be exposed, so the contact portion 212 extends into the cavity 10 to be connected to the first capillary structure 13, and thereby the first and second capillary structures 13, 21 communicate with each other.

In the present embodiment, for purposes of describing clear examples, the insertion end of the heat pipe 2 is inserted into the cavity 10 to contact a bottom thereof, so as to make the contact portion 212 in stable contact with the first capillary structure 13, and thereby the first and second capillary structures 13, 21 communicate with each other.

Each heat pipe 2 is inserted through the second plate 12 for fixed connection therewith by any suitable method such as making an outer wall surface of each heat pipe 2 in contact with the flange 122 and soldered thereto, thereby enhancing structural stability between the heat pipe 2 and the vapor chamber 1. Each heat pipe 2 is vertically inserted through the second plate 12, or the heat pipe 2 can form an included angle of 70 to 110 degrees with the second plate 12. The heat pipe 2 intersects the second plate 12, no matter whether the heat pipe 2 is vertically inserted or forms the included angle.

Figure 1:
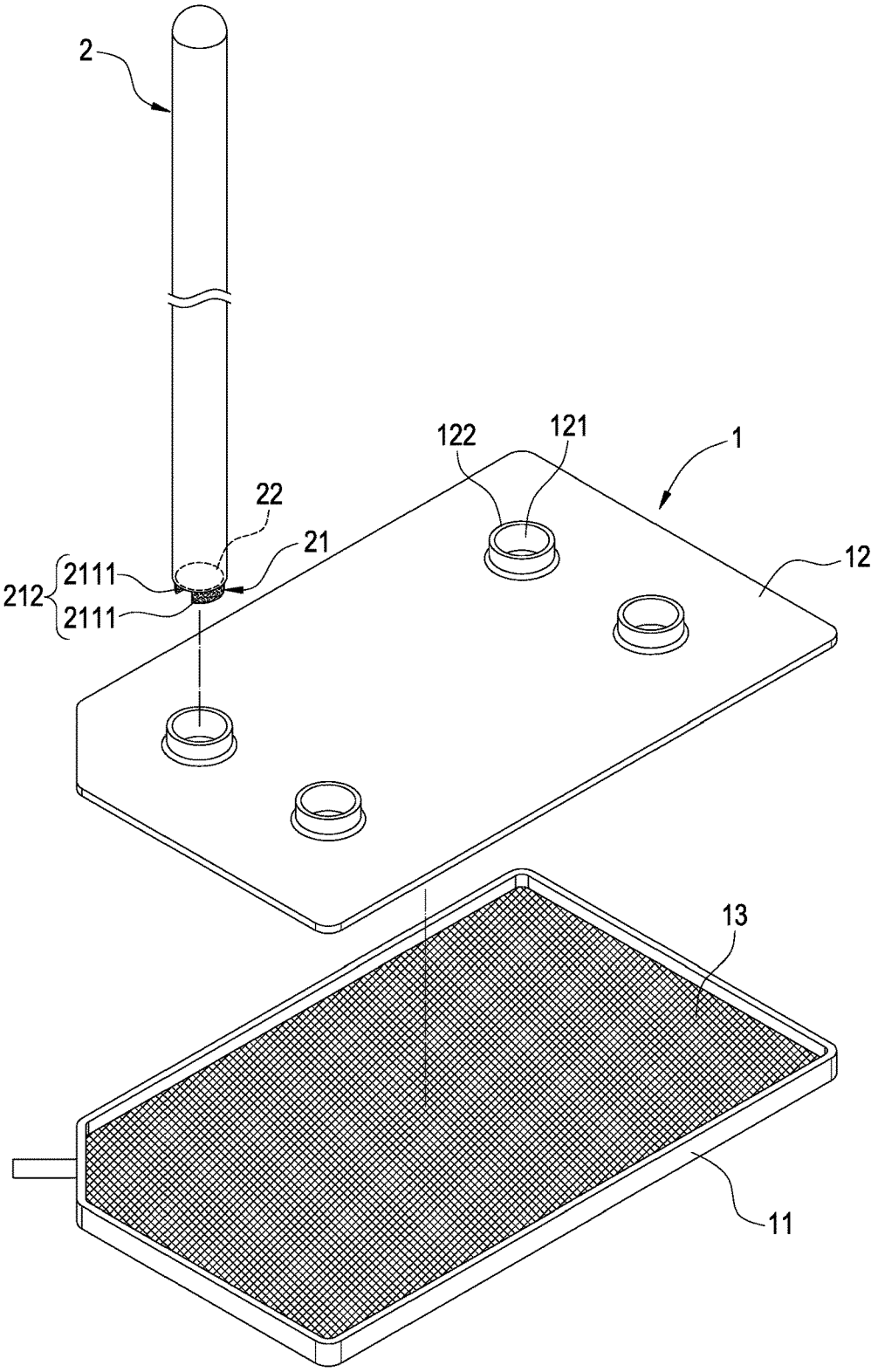
FIG. 1 is a perspective exploded view according to the first embodiment of the present invention.
Figure 2:
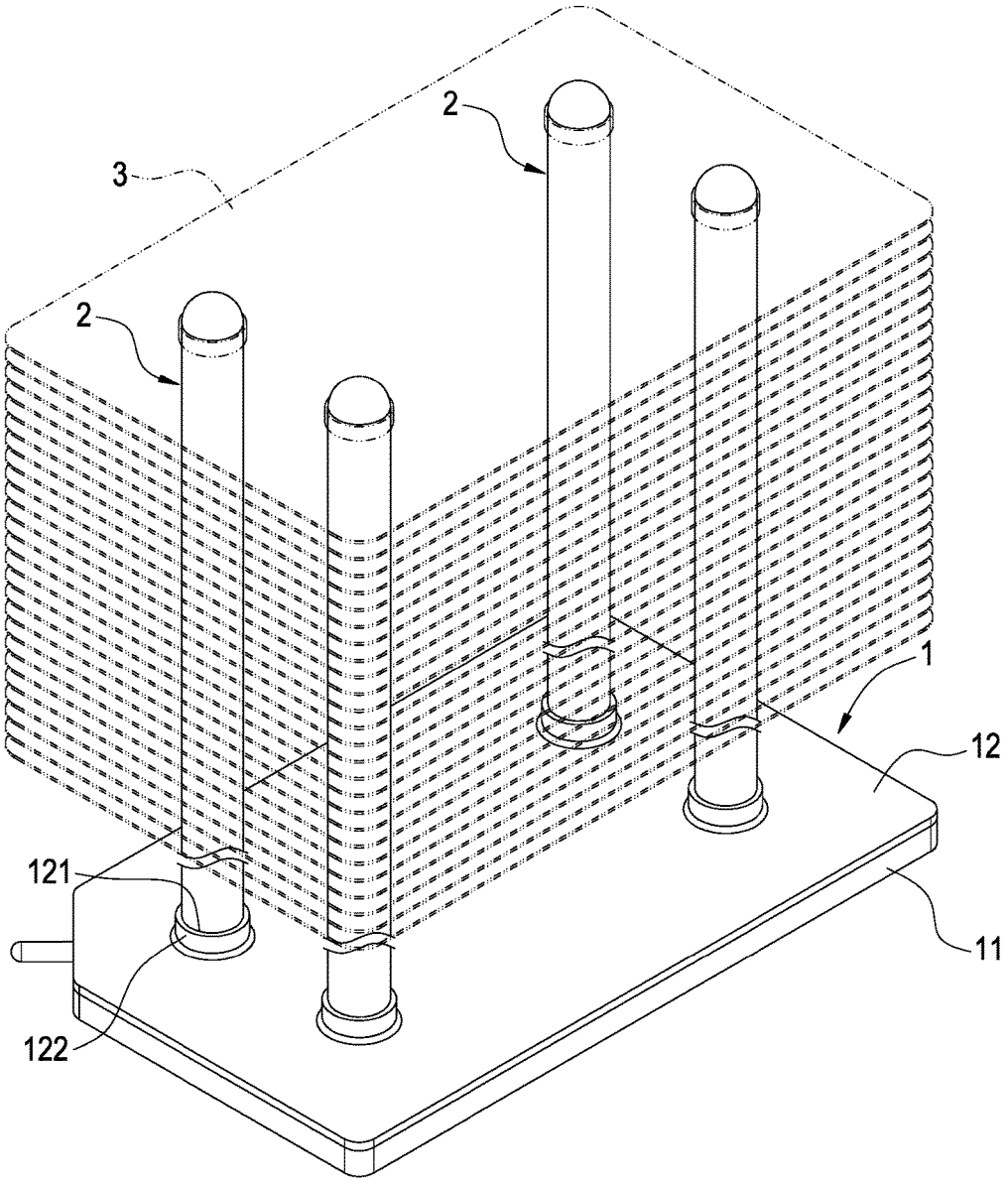
FIG. 2 is a perspective assembled view according to the first embodiment of the present invention.
Figure 3:
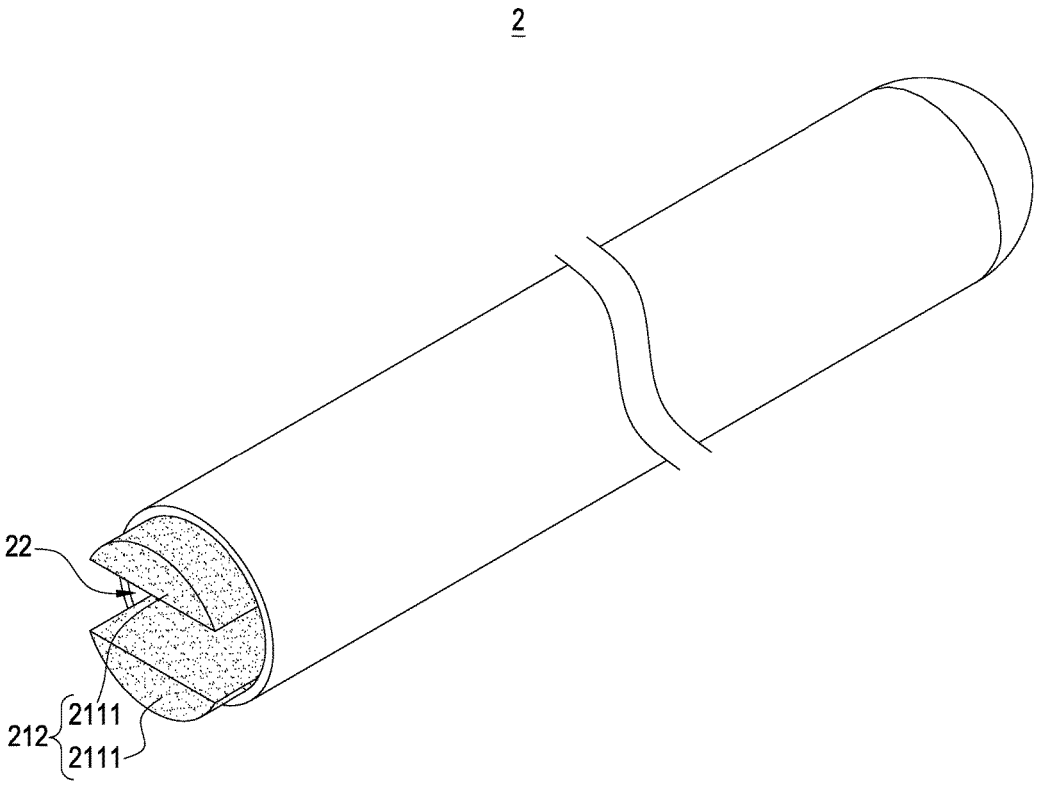
FIG. 3 is a perspective view from another viewing angle illustrating a heat pipe according to the first embodiment of the present invention.
Figure 4:
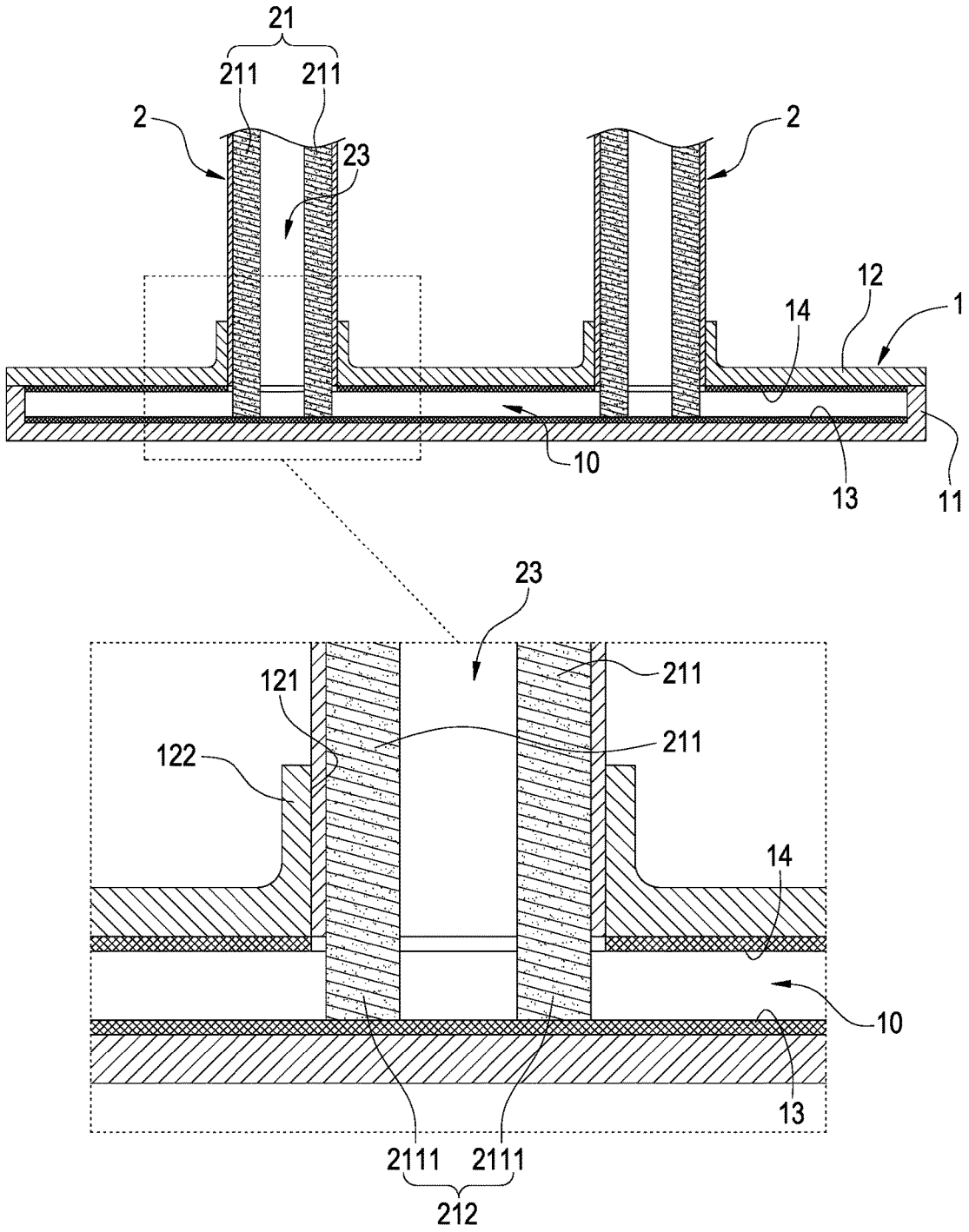
FIG. 4 is a cross-sectional view and also a partial enlarged view of FIG. 2 according to the first embodiment of the present invention.

As shown in FIGS. 2 and 4, the heat pipe 2 inserted into the cavity of the vapor chamber 1 is in erected condition, and the second capillary structure 21 inside the heat pipe 2 and the first capillary structure 13 inside the vapor chamber 1 contact and communicate with each other. As a result, an overall three-dimensional heat transfer effect can be achieved, thus desired ideal heat dissipation can be effected.

In addition, the two capillary elements 211 of the second capillary structure 21 and the two exposed sections 2111 thereof are spaced apart to form the vapor passage 23, so when the contact portion 212 of the heat pipe 2 is in contact with the first capillary structure 13, vapor can circulate via the vapor passage 23, and a hollow space inside the heat pipe 2 communicates with the cavity 10 of the vapor chamber 1, thereby enhancing heat dissipation. Certainly, after the contact portion 212 extending out of the heat pipe 2 and exposed therefrom is inserted into the cavity 10, a portion of the heat pipe 2, having the contact portion 212 extending out, also communicates with the cavity 10, thus having a function similar to the vapor passage 23.

In addition to contacting and communicating with the first capillary structure 13, the second capillary structure 21 of each heat pipe 2 can also connect and communicate with (not illustrated) the third capillary structure 14. In fact, just by making the second capillary structure 21 contact and communicate with the first capillary structure 13, the second capillary structure 21 can dissipate heat properly.

Furthermore, as shown in FIG. 2, the three-dimensional heat transfer device can further includes a fin set 3, the fin set 3 is assembled onto the heat pipe 2, so that the heat of the heat pipe 2 can be transferred to the fin set 3, thereby facilitating dissipating the heat of the fin set 3 by a fan not illustrated in the drawing.

Please refer to FIGS. 5 to 7 showing the three-dimensional heat transfer device according to the second embodiment of the present invention. The second embodiment is similar to the first embodiment with the difference that the heat pipe 2*a* in the second embodiment is different from the heat pipe 2 in the first embodiment, as more fully detailed below.

The heat pipe 2*a* (see FIG. 7) includes an inner section 2711 inside the cavity 10, an outer section 2712 outside the cavity 10, and an insertion section (not labelled) connected between the inner section 2711 and the outer section 2712 and fixed to the flange 122. A portion of the inner section 2711 forms an opening 22, and the opening 22 can be circular, rectangular or can be of a tear drop shape; the present invention is not limited in this regard. The opening 22 can be enlarged from a tube end (i.e. the insertion end) of the heat pipe 2*a* to a tube body to also permit circulation of the vapor (as shown in FIG. 6A). Alternatively, the opening 22 can be formed first, and then a plurality of gaps 24 (as shown in FIG. 5 or FIG. 6B) are formed directly on the tube body, so that the gaps 24 can serve as a vapor opening for the vapor to circulate therethrough. To be specific, the opening 22 is formed at a free end (i.e. the insertion end of the heat pipe 2*a*) of the inner section 2711, each gap 24 is formed at the inner section 2711 (which is also the tube body of the heat pipe 2*a*), and the gaps adjoin the opening 22 to communicate with each other, so the gaps 24 can serve as the vapor opening for the vapor to circulate therethrough.

The heat pipe in the second embodiment can be the heat pipe 2*a* of the first type in FIG. 6A and can also be the heat pipe 2*a* of the second type in FIG. 6B; the present invention is not limited in this regard, although for the purpose of describing the second embodiment, the heat pipe 2*a* of the second type shown in the FIG. 6B is taken as an example.

The second capillary structure 27 includes a contact portion 272 which is arranged in the opening 22 and exposed. In the present embodiment, the contact portion 272 is a rim of the second capillary structure 27, which is exposed corresponding to the opening 22. The contact portion 272 can flush with or slightly shrink inwardly into the free end (or into the insertion end of the heat pipe 2*a*) of the inner section 2711.

The heat pipe 2*a* is vertically inserted through the second plate 12, and the inner section 2711 extends into the cavity 10, so that the contact portion 272 can be connected to the first capillary structure 13 via the opening 22 to make the first and second capillary structures 13, 27 communicate with each other. To be specific, the inner section 2711 contacts, by its free end, the first capillary structure 13, and therefore the contact portion 272 together with the inner section 2711 contacts the first capillary structure 13.

In summary, compared with conventional techniques, the present invention provides the following functions. By making the second capillary structure 21, 27 of the heat pipe 2, 2*a* connected and communicating with the first capillary structure 13 of the vapor chamber 1, overall three-dimensional heat transfer is achieved, and a desired optimized heat dissipation effect can be obtained when the vapor chamber 1 collaborates with the heat pipe 2, 2*a*.

The present invention further has other functions. By spacing the two capillary structures 211 to be apart from each other to form the vapor passage 23 or by forming the opening 22 of the heat pipe 2*a*, a hollow space inside the heat pipe 2, 2*a* is in communication with the cavity 10 of the vapor chamber 1, thereby promoting heat dissipation. Certainly, after the contact portion 212 extending out of the heat pipe 2 and exposed therefrom is inserted into the cavity 10, a portion of the heat pipe 2, having the contact portion 212 extending out, also communicates with the cavity 10, thus achieving an effect similar to the vapor passage 23.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A three-dimensional heat transfer device, comprising:

a vapor chamber, the vapor chamber including a first plate and a second plate opposite to each other, a first capillary structure being disposed on an inner surface of the first plate; and a heat pipe, a second capillary structure being disposed inside the heat pipe, the second capillary structure having a contact portion extending out of the heat pipe and exposed therefrom, wherein the heat pipe is inserted through the second plate, and the contact portion extends into the vapor chamber and is connected to the first capillary structure, so that the first capillary structure and the second capillary structure communicate with each other, wherein the second capillary structure includes two capillary elements arranged spaced apart and parallel to each other, the two capillary elements are physically separate from each other, and a vapor passage is formed between the two capillary elements.

2. The three-dimensional heat transfer device of claim 1, wherein the heat pipe includes an opening, the opening is exposed within the vapor chamber, and the contact portion extends from the opening to be exposed.

3. The three-dimensional heat transfer device of claim 1, wherein the contact portion extends from one end of the heat pipe to be exposed, and the contact portion of the second capillary structure is in contact with the first capillary structure, so that the first capillary structure and second capillary structure communicate with each other.

4. The three-dimensional heat transfer device of claim 1, wherein each of the two capillary elements includes an exposed section, and the contact portion includes the exposed section of each of the two capillary elements.

5. The three-dimensional heat transfer device of claim 1, wherein the heat pipe is vertically inserted through the second plate, or the heat pipe forms an included angle of 70 to 110 degrees with the second plate.

6. The three-dimensional heat transfer device of claim 1, wherein the second plate forms an insertion hole, the heat pipe is inserted through the insertion hole correspondingly, a flange in a circular form extends from a periphery of the insertion hole, and an outer wall of the heat pipe is fixed to the flange.

7. The three-dimensional heat transfer device of claim 1, further comprising a fin set, the fin set being assembled onto the heat pipe.

8. The three-dimensional heat transfer device of claim 1, wherein the first capillary structure is only formed on the inner surface of the first plate, and an inner surface of the second plate does not have a capillary structure.

9. A three-dimensional heat transfer device, comprising:

a vapor chamber, the vapor chamber including a first plate and a second plate opposite to each other, a first capillary structure being disposed on an inner surface of the first plate; and a heat pipe, the heat pipe being disposed with a second capillary structure inside and including an inner section, the inner section including an opening, the second capillary structure including a contact portion which is arranged in the opening and exposed, the heat pipe being inserted through the second plate, the inner section extending into the vapor chamber, the contact portion being connected to the first capillary structure via the opening, so that the first capillary structure and the second capillary structure communicate with each other, wherein a portion of the inner section forms the opening, the portion of the inner section is in direct contact with the first capillary structure, the contact portion and the inner section are in direct contact with the first capillary structure, so that the first capillary structure and the second capillary structure communicate with each other.

10. The three-dimensional heat transfer device of claim 9, wherein the heat pipe is vertically inserted through the second plate, or the heat pipe forms an included angle of 70 to 100 degrees with the second plate.

11. The three-dimensional heat transfer device of claim 9, wherein the second plate forms an insertion hole, the heat pipe is inserted through the insertion hole correspondingly, a flange in a circular form extends from a periphery of the insertion hole, and an outer wall of the heat pipe is fixed to the flange.

12. The three-dimensional heat transfer device of claim 9, further comprising a fin set, the fin set being assembled onto the heat pipe.

13. The three-dimensional heat transfer device of claim 9, wherein the first capillary structure is only formed on the inner surface of the first plate, and an inner surface of the second plate does not have a capillary structure.

14. A three-dimensional heat transfer device, comprising:

a vapor chamber, the vapor chamber including a first plate and a second plate opposite to each other, a first capillary structure being disposed on an inner surface of the first plate; and a heat pipe, the heat pipe being disposed with a second capillary structure inside and including an inner section, the inner section including an opening and at least one gap, the opening being formed at a free end of the inner section, the at least one gap being formed on a tube body of the inner section of the heat pipe, the at least one gap being adjacent to the opening and communicates therewith, the second capillary structure including a contact portion which is arranged in the opening and exposed, the heat pipe being inserted through the second plate, the inner section extending into the vapor chamber, the contact portion being connected to the first capillary structure via the opening, so that the first capillary structure and the second capillary structure communicate with each other.

15. The three-dimensional heat transfer device of claim 14, wherein the heat pipe is vertically inserted through the second plate, or the heat pipe forms an included angle of 70 to 110 degrees with the second plate.

16. The three-dimensional heat transfer device of claim 14, wherein the second plate forms an insertion hole, the heat pipe is inserted through the insertion hole correspondingly, a flange in a circular form extends from a periphery of the insertion hole, and an outer wall of the heat pipe is fixed to the flange.

17. The three-dimensional heat transfer device of claim 14, further comprising a fin set, the fin set being assembled onto the heat pipe.

18. The three-dimensional heat transfer device of claim 14, wherein the first capillary structure is only formed on the inner surface of the first plate, and an inner surface of the second plate does not have a capillary structure.

* * * * *